US010087954B2

(12) United States Patent
Wang

(10) Patent No.: US 10,087,954 B2
(45) Date of Patent: Oct. 2, 2018

(54) HVAC SYSTEM WITH NOISE REDUCING TUBE

(71) Applicant: Trane International Inc., Piscataway, NJ (US)

(72) Inventor: Percy F. Wang, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 864 days.

(21) Appl. No.: 14/170,196

(22) Filed: Jan. 31, 2014

(65) Prior Publication Data

US 2014/0227081 A1 Aug. 14, 2014

Related U.S. Application Data

(60) Provisional application No. 61/762,764, filed on Feb. 8, 2013.

(51) Int. Cl.
*F04D 29/66* (2006.01)
*F04D 25/08* (2006.01)

(52) U.S. Cl.
CPC ..... *F04D 29/664* (2013.01); *F04D 25/08* (2013.01); *F04D 29/665* (2013.01); *Y10T 29/49318* (2015.01)

(58) Field of Classification Search
CPC .... F04D 29/664; F04D 29/665; F04D 29/526; F04D 29/547; F04D 25/08
See application file for complete search history.

(56) References Cited

U.S. PATENT DOCUMENTS

| | | | | |
|---|---|---|---|---|
| 2,252,256 | A * | 8/1941 | Harris | B64C 11/00 181/247 |
| 4,692,091 | A * | 9/1987 | Ritenour | F04D 29/526 415/119 |
| 5,314,300 | A | 5/1994 | Gatley, Jr. et al. | |
| 5,316,439 | A | 5/1994 | Gatley, Jr. et al. | |
| 5,452,362 | A | 9/1995 | Burward-Hoy | |
| 6,309,176 | B1 | 10/2001 | Periyathamby et al. | |
| 6,896,095 | B2 | 5/2005 | Shah et al. | |
| 7,695,553 | B2 | 4/2010 | Celik et al. | |
| 7,766,996 | B2 | 8/2010 | Celik et al. | |
| 7,856,837 | B2 | 12/2010 | Yamashita et al. | |
| 7,891,464 | B2 * | 2/2011 | Tang | F04D 25/08 181/224 |
| 7,992,674 | B2 | 8/2011 | Gorny et al. | |
| 8,033,358 | B2 | 10/2011 | Ivers | |
| 8,123,468 | B2 | 2/2012 | Shirahama et al. | |
| 2001/0018022 | A1 * | 8/2001 | Nakamura | F04D 29/545 415/203 |
| 2003/0183446 | A1 * | 10/2003 | Shah | F01P 5/06 181/205 |
| 2004/0045767 | A1 * | 3/2004 | Byrne | F02C 7/045 181/241 |

(Continued)

*Primary Examiner* — Logan Kraft
*Assistant Examiner* — Danielle M Christensen
(74) *Attorney, Agent, or Firm* — Conley Rose, P.C.; J. Robert Brown, Jr.

(57) ABSTRACT

A heating, ventilation, and/or air conditioning (HVAC) system has a fan component defining a radially interior space and a radially exterior space and a tube disposed in the radially exterior space, the tube being in fluid communication with the radially interior space at a first angular location and a second angular location different from the first angular location.

15 Claims, 10 Drawing Sheets

(56) References Cited

U.S. PATENT DOCUMENTS

2005/0205351 A1* 9/2005 D'Angelo ..... F01N 1/00
181/216
2008/0020199 A1* 1/2008 Augele ..... B60R 13/0815
428/312.6
2009/0308685 A1* 12/2009 Gorny ..... F04D 29/663
181/205

* cited by examiner

HVAC SYSTEM WITH NOISE REDUCING TUBE

CROSS-REFERENCE TO RELATED APPLICATIONS

The present application claims priority to U.S. Provisional Patent Application No. 61/762,764 filed on Feb. 8, 2013 by Percy F. Wang, entitled "HVAC System With Noise Reducing Tube," which is incorporated by reference herein as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generate noise as air is forced between rotating fan blades and closely located fan shrouds. In some cases, local noise regulations may limit amplitude of noise allowed as a result of operating an HVAC system.

DETAILED DESCRIPTION

This disclosure provides, in some embodiments, systems and methods for selectively reducing noise emitted by a heating, ventilation, and/or air conditioning (HVAC) fan and/or blower system by fluidly connecting at least two angular locations via a tube or passageway. In some embodiments, a frequency or tone of the noise may be selected by adjusting an effective length of the tube or passageway. In some embodiments, the tube or passage way may be integral with a fan shroud and/or may be provided with sound wave absorptive structures and/or materials.

Figure 1:
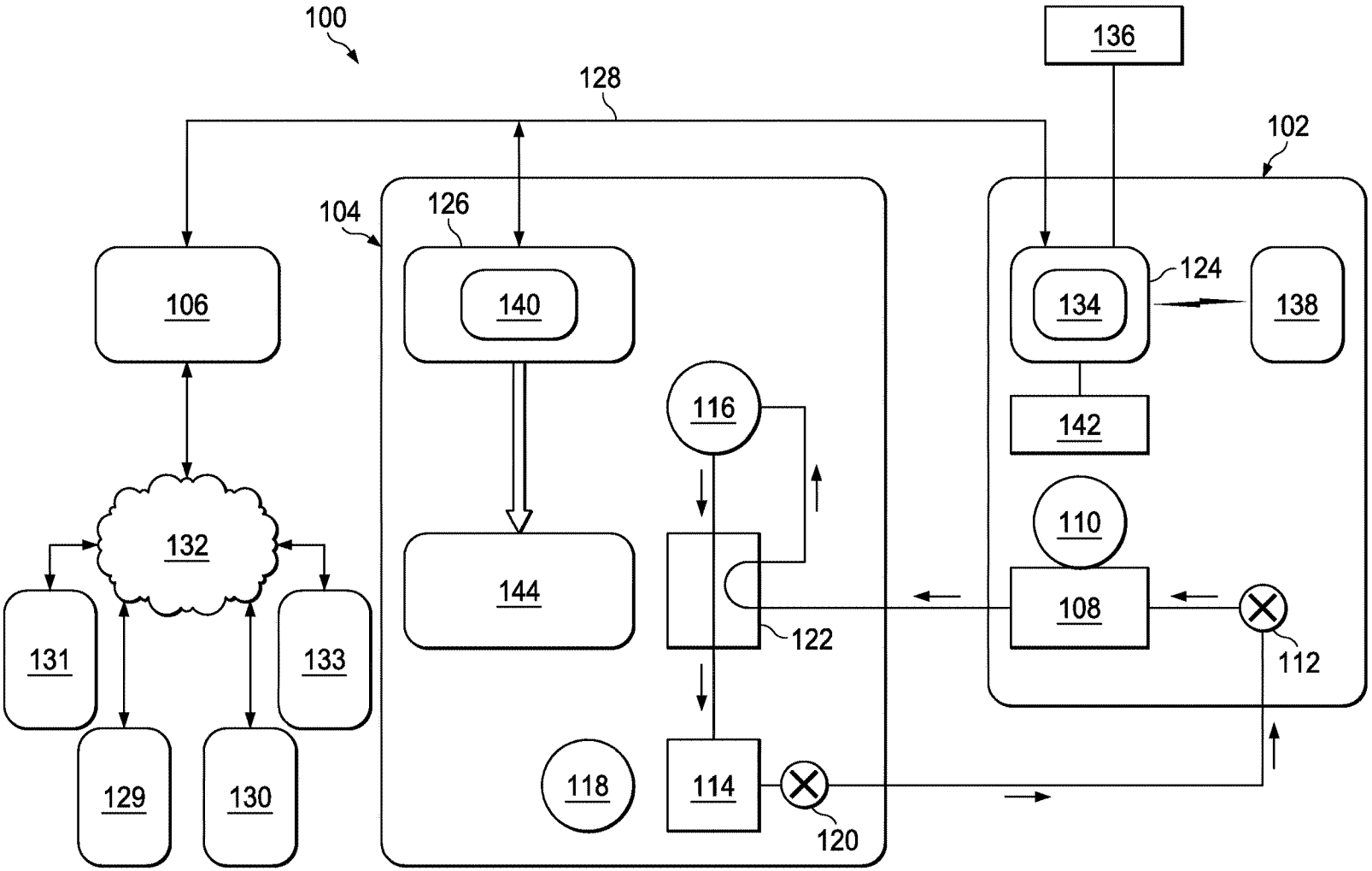
FIG. 1 is a schematic diagram of an HVAC system according to an embodiment of the disclosure.

Referring now to FIG. 1, a schematic diagram of an HVAC system 100 according to an embodiment of this disclosure is shown. HVAC system 100 comprises an indoor unit 102, an outdoor unit 104, and a system controller 106. In some embodiments, the system controller 106 may operate to control operation of the indoor unit 102 and/or the outdoor unit 104. As shown, the HVAC system 100 is a so-called heat pump system that may be selectively operated to implement one or more substantially closed thermodynamic refrigeration cycles to provide a cooling functionality and/or a heating functionality.

Indoor unit 102 comprises an indoor heat exchanger 108, an indoor fan 110, and an indoor metering device 112. Indoor heat exchanger 108 is a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger.

The indoor fan 110 is a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 is configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

Outdoor unit 104 comprises an outdoor heat exchanger 114, a compressor 116, an outdoor fan 118, an outdoor metering device 120, and a reversing valve 122. Outdoor heat exchanger 114 is a spine fin heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a microchannel heat exchanger, or any other suitable type of heat exchanger.

The compressor 116 is a multiple speed scroll type compressor configured to selectively pump refrigerant at a plurality of mass flow rates. In alternative embodiments, the compressor 116 may comprise a modulating compressor capable of operation over one or more speed ranges, the compressor 116 may comprise a reciprocating type compressor, the compressor 116 may be a single speed compressor, and/or the compressor 116 may comprise any other suitable refrigerant compressor and/or refrigerant pump.

The outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor metering device 120 is a thermostatic expansion valve. In alternative embodiments, the outdoor metering device 120 may comprise an electronically controlled motor driven EEV, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

The reversing valve 122 is a so-called four-way reversing valve. The reversing valve 122 may be selectively controlled to alter a flow path of refrigerant in the HVAC system 100 as described in greater detail below. The reversing valve 122 may comprise an electrical solenoid or other device configured to selectively move a component of the reversing valve 122 between operational positions.

The system controller 106 may comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system 100.

In some embodiments, the system controller 106 may selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or other device 130 via a communication network 132. In some embodiments, the communication network 132 may comprise a telephone network and the other device 130 may comprise a telephone. In some embodiments, the communication network 132 may comprise the Internet and the other device 130 may comprise a so-called smartphone and/or other Internet enabled mobile telecommunication device.

The indoor controller 124 may be configured to receive information inputs, transmit information outputs, and otherwise communicate with the system controller 106, the outdoor controller 126, and/or any other device via the communication bus 128 and/or any other suitable medium of communication. In some embodiments, the indoor controller 124 may be configured to communicate with an indoor personality module 134, receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

In some embodiments, the indoor EEV controller 138 may be configured to receive information regarding temperatures and pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112.

The outdoor controller 126 may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may be pumped from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to gaseous phase. The gaseous phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. The refrigerant may thereafter reenter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may reenter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Still further, the system controller 106 may be configured to selectively communicate with other systems via the communication network 132. In some embodiments, the system controller 106 may communicate with weather forecast data providers (WFDPs) 133 which may provide weather forecast data via the network 132. In some embodiments, the system controller 106 may communicate with a customized data provider (CDP) 131, such as a home automation service provider. In this embodiment, the CDP 131 may be designated or authorized by the system controller 106 manufacturer to store data such as a location of an HVAC system 100 installation, HVAC system 100 model number, HVAC system 100 serial number, and/or other HVAC system 100 data for and/or from system controllers 106. Such data may further comprise details on the installation of the HVAC system 100, including features, locations, and/or proximities of buildings and physical installation sites. Further acoustic related details may comprise type of plants, type of soil and/or ground, grades of ground and/or plant environment.

Still further, such data may comprise sensor based feedback regarding acoustic performance data of the HVAC system 100. Other acoustic related data may be provided by any of the HVAC system 100 owner, the HVAC system 100 installer, the HVAC system 100 distributor, the HVAC system 100 manufacturer, and/or any other entity associated with the manufacture, distribution, purchase, operation, and/or installation of HVAC system 100. The CDP 131 may also collect, process, store, and/or redistribute information supplied from system controllers 106. Such information may comprise measurements of acoustic conditions local to the HVAC system 100 and/or any other information available to the system controller 106.

System controller 106 may also be configured to communicate with other data providers 129. Such other data providers 129 may provide acoustic performance requirement information, legal acoustic maximums, and/or other information resources related to managing the acoustics and/or acoustic outputs of the HVAC system 100. For example, system controller 106 may communicate with a local municipality to retrieve noise violation threshold values, such as, but not limited to, a decibel limit.

Figure 2:
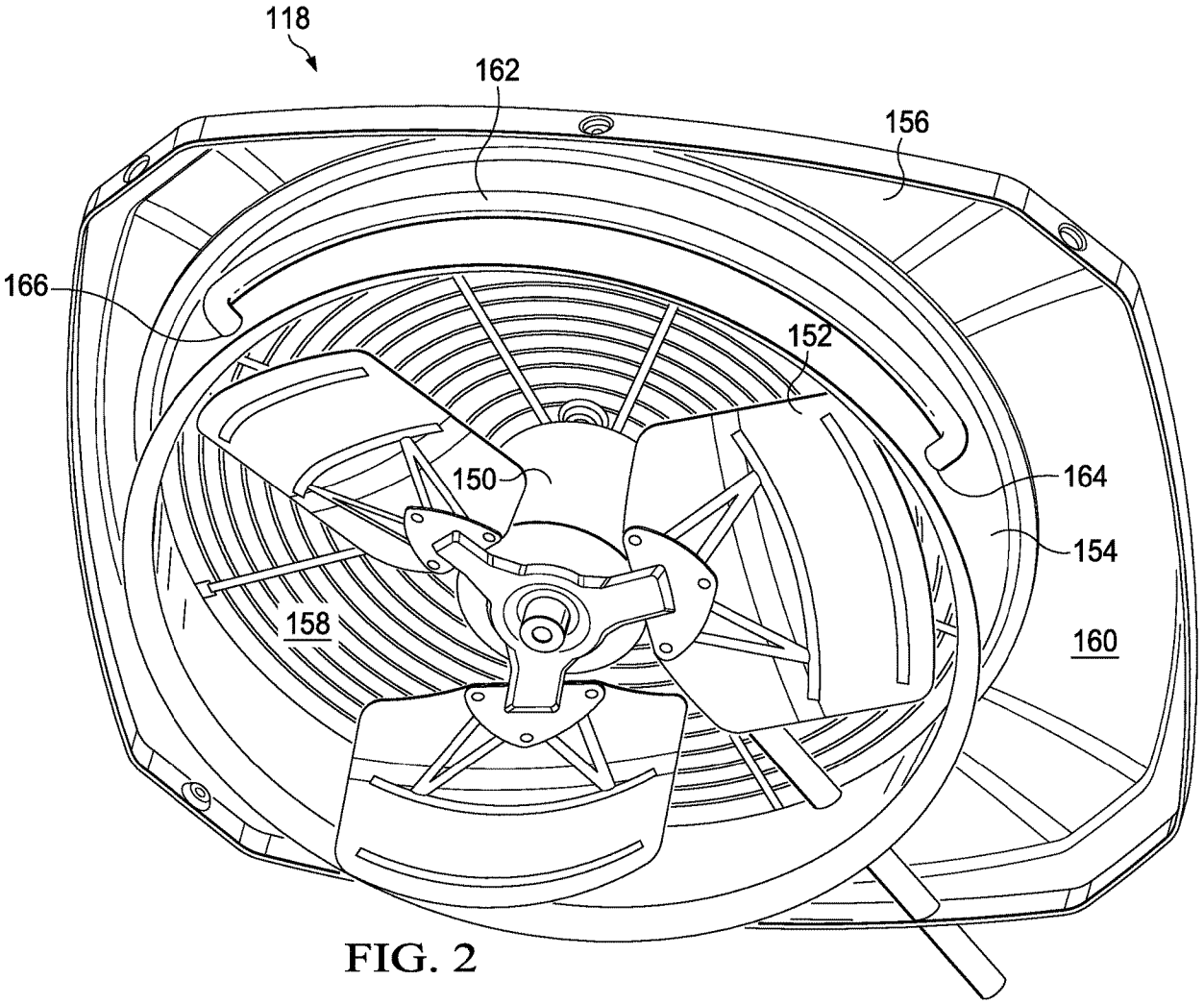
FIG. 2 is an oblique view of an outdoor fan of the HVAC system of FIG. 1.

Referring now to FIG. 2, a portion of outdoor fan 118 is shown. The outdoor fan 118 comprises a fan motor 150, a blade assembly 152, a shroud 154, and a cover 156. The shroud 154 may generally define an interior space 158 bounded by the shroud 154. In some embodiments, at least a portion of the blade assembly 152 may be disposed within the interior space 158. The shroud 154 may similarly define an exterior space 160 defined as the space radially beyond the shroud 154 and which generally lies within a vertical footprint of the cover 156. In this embodiment, a tube 162 is located in the exterior space 158 and the interior of the tube 162 is in fluid connection with the interior space 158 at a first angular location 164 and a second angular location 166. By providing a sound pressure transmission path between the first and second angular locations 164, 166, a pressure condition at one or both of the first and second angular locations 164, 166 may be disrupted to reduce noise. In some embodiments, the noise reduced is associated with a blade passing frequency (BPF). In some embodiments, the overall effective length of the tube 162 may be selected as a multiple of a BPF wavelength, a fraction of the BPF wavelength, a harmonic of the BPF wavelength, and/or any other suitable relationship to the BPF. In this embodiment, with a longitudinal direction being generally defined as a direction substantially parallel to a central axis of the shaft of the motor 150, the first and second angular locations 164, 166 are located substantially in the same longitudinal locations along the longitudinal length of the outdoor fan 118. In this embodiment, the first and second angular locations 164, 166 may be located at longitudinal locations selected to connect the tube 162 in close proximity to a tip of the blades of the blade assembly 152. In some cases, the longitudinal locations of the first and second angular locations 164, 166 may be selected to maximize an overlap between the first and second angular locations 164, 166 and the tips and/or radially outward edges of the blades of the blade assembly 152 so that energy, pressure, and/or noise generally associated with the interaction of the blade tips and the shroud 154 is transmitted into the tube 162. In alternative embodiments, tubes may be connected at longitudinal locations that are identical, partially overlap longitudinally, are adjacent longitudinally, and/or are offset from each other longitudinally. In alternative embodiments, a noise and/or pressure attenuation material patch and/or surface feature may be applied to and/or integrally formed with the shroud 154 between the shroud 154 and the tips of the blades of the blade assembly 152 to similarly disrupt, reduce, and/or prevent a pressure wave such as a standing pressure wave. In some embodiments, the location of the noise attenuation material patches may be angularly located in substantially the same manner as the tube 162 and/or other tubes disclosed herein.

Figure 3:
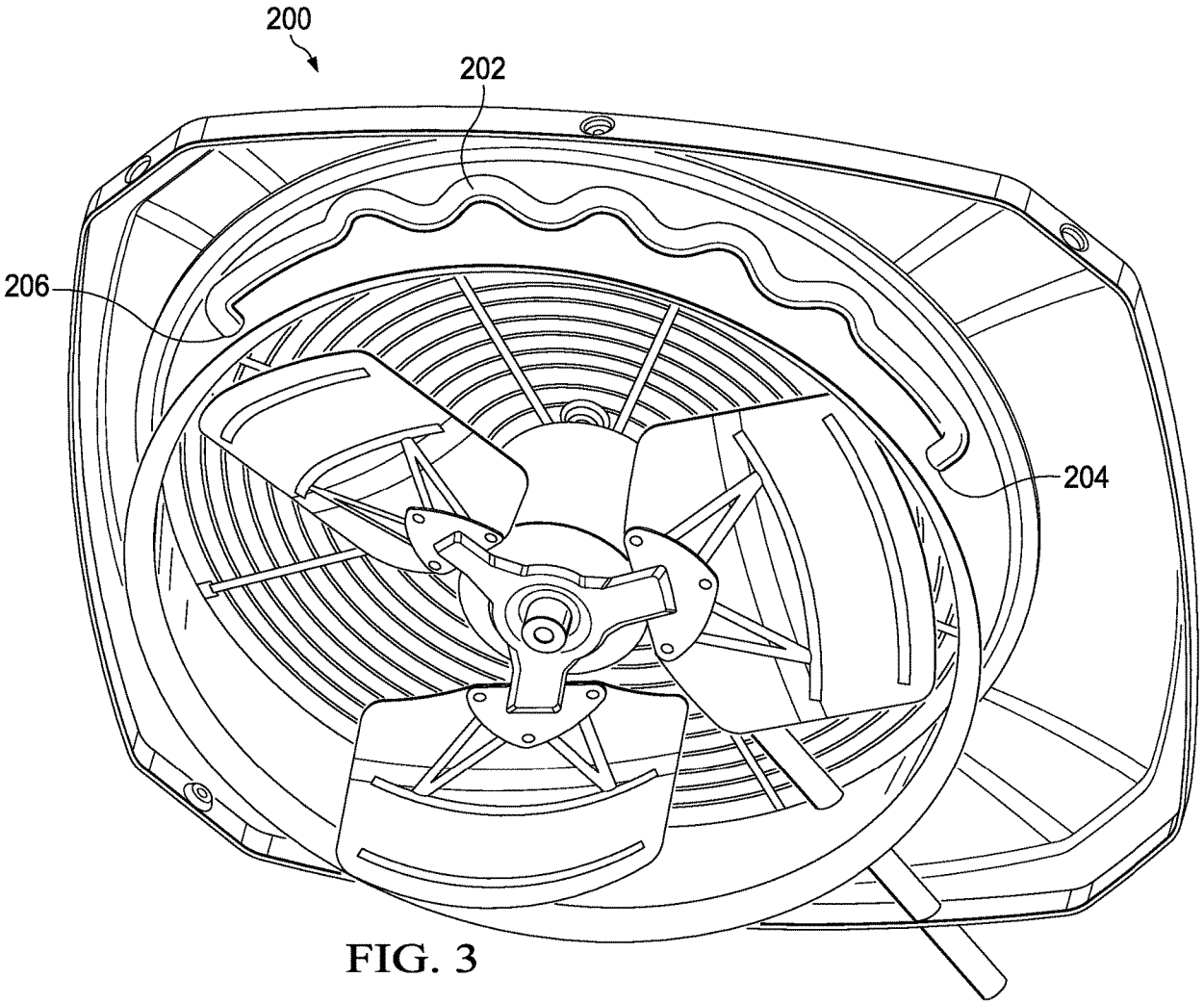
FIG. 3 is an oblique view of a fan assembly according to another embodiment of the disclosure.

Referring now to FIG. 3, an HVAC fan assembly 200 substantially similar to outdoor fan 118 is shown. The HVAC fan assembly 200 comprises a tube 202 comprising a meandering, flexible, and/or variable length. In some cases, the tube 202 may be collapsed to provide a relatively shorter wavelength path to better attenuate relatively higher frequency noises. In some cases, the tube 202 may be kinked or otherwise provided with increased undulations to decrease an ease with which a pressure wave may pass between a first angular location 204 and a second angular location 206.

Figure 4:
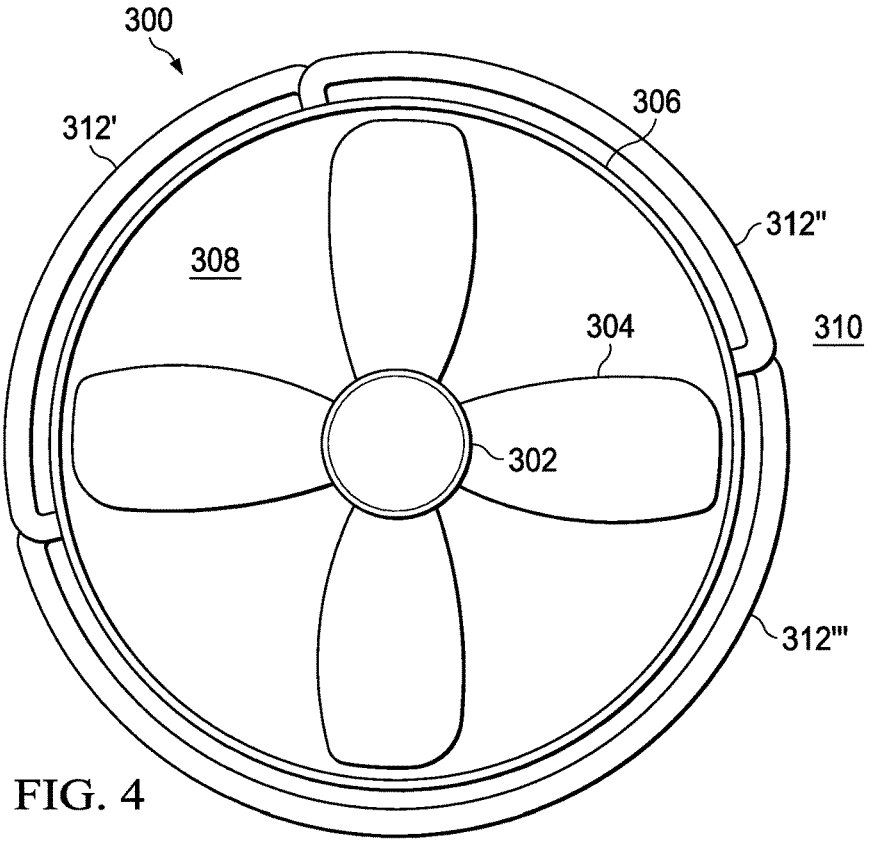
FIG. 4 is a schematic view of a fan assembly according to another embodiment of the disclosure.

Referring now to FIG. 4, an HVAC fan assembly 300 substantially similar to outdoor fan 118 is shown. HVAC fan assembly 300 comprises a motor 302, a blade assembly 304, and a shroud 306. The shroud 306 may generally define an interior space 308 and an exterior space 310. HVAC fan assembly 300 comprises three tubes 312', 312", and 312'". In this embodiment, tube 312 shares an angular attachment location with each of the tube 312" and the tube 312'". Although the angular locations of the tube attachments may be the same or at least partially overlap, the fluid passages of the attachments may be offset longitudinally relative to each other so that, in some cases, the HVAC fan assembly 300 comprises six holes formed in the shroud 306 to provide the fluid connections for the three tubes 312', 312", 312'". In some cases, multiple tubes may be fluidly connected to the interior space 308 at some shared angular locations.

Figure 5:
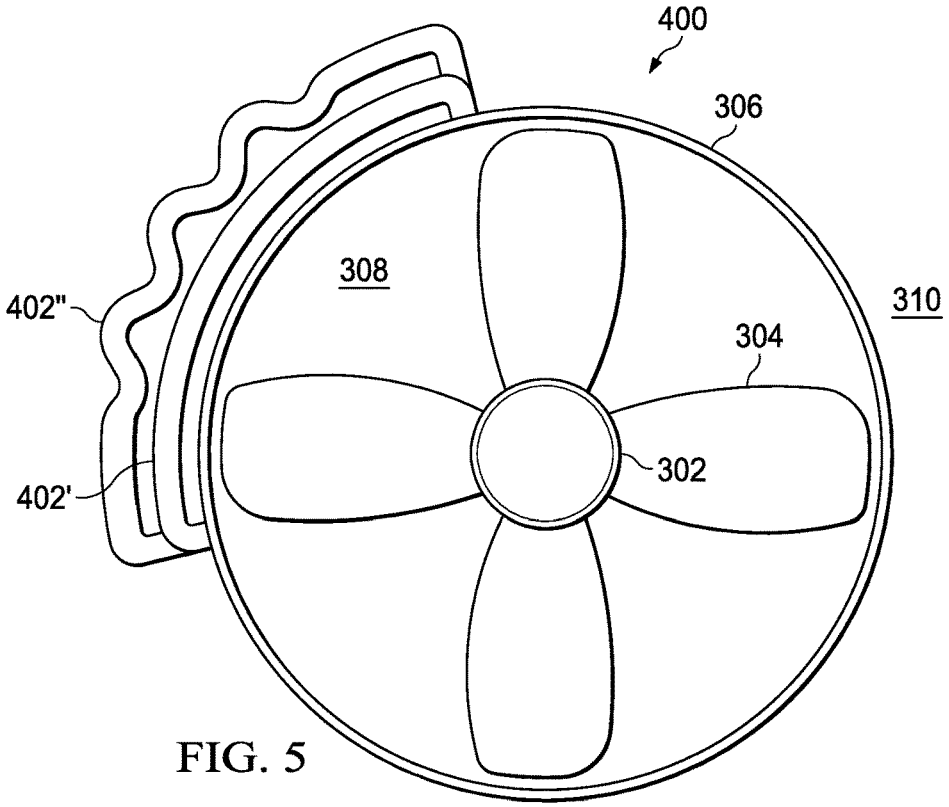
FIG. 5 is a schematic view of a fan assembly according to another embodiment of the disclosure.

Referring now to FIG. 5, an HVAC fan assembly 400 substantially similar to outdoor fan 118 is shown. In this embodiment, multiple tubes 402', 402" may be connected to substantially the same angular locations even though the multiple tubes 402', 402" comprise different effective lengths relative to each other. In this case, the tube 402' comprises a relatively shorter internal passage length as compared to the relatively more meandering and longer tube 402".

Figure 6:
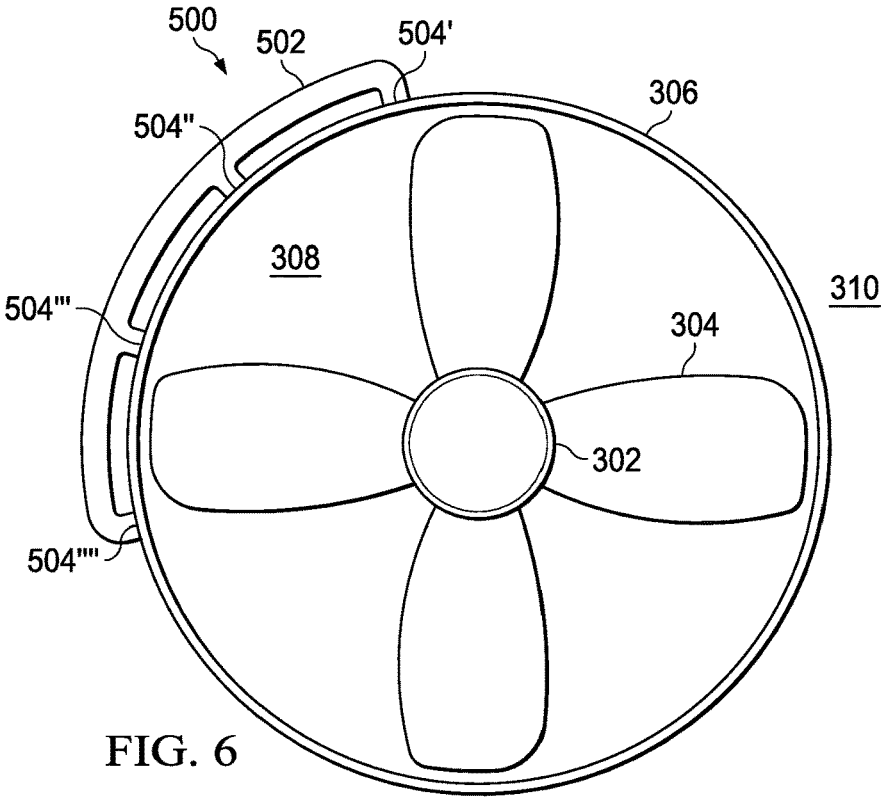
FIG. 6 is a schematic view of a fan assembly according to another embodiment of the disclosure.

Referring now to FIG. 6, an HVAC fan assembly 500 substantially similar to outdoor fan 118 is shown. In this embodiment, a tube 502 may be fluidly connected to the interior space 308 in more than two angular locations and/or at more than two locations along the effective length of the tube 502. In this case, the tube 502 is connected at four angular locations 504', 504", 504'", and 504"" on the shroud 306.

Figure 7:
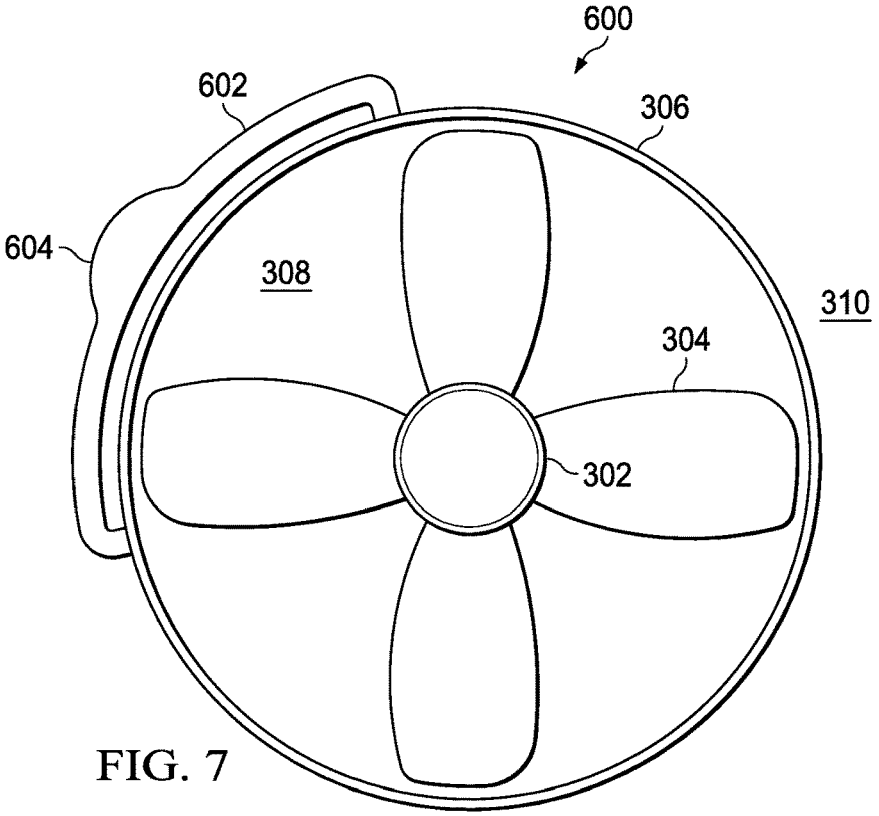
FIG. 7 is a schematic view of a fan assembly according to another embodiment of the disclosure.

Referring now to FIG. 7, an HVAC fan assembly 600 substantially similar to outdoor fan 118 is shown. In this embodiment, a tube 602 may comprise an enlarged internal space portion 604 disposed along the effective length of the tube 602. The size and/or shape of the enlarged internal space portion 604 may be provided with sound dampening materials and/or may be selectively variable in size and/or effective length.

Figure 8:
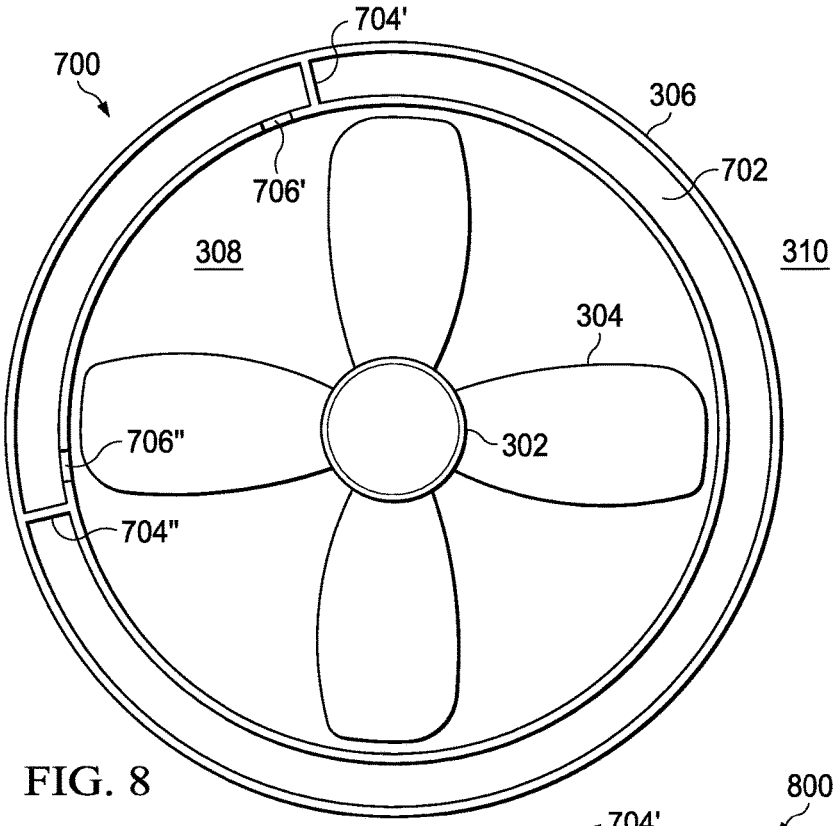
FIG. 8 is a schematic view of a fan assembly according to another embodiment of the disclosure.

Referring now to FIG. 8, an HVAC fan assembly 700 substantially similar to outdoor fan 118 is shown. In this embodiment, the shroud 306 may comprise an annular interior space 702. In some embodiments, the HVAC fan assembly 700 may comprise one or more shroud dividers, in this case, two shroud dividers 704', 704", that may be selectively placed within the annular interior space 702 to effectively angularly divide the annular interior space 702. In some cases, one or more shroud apertures, in this case shroud apertures 706', 706", may be selectively punched, unplugged, and/or otherwise selectively provided to join one or more angular sections of the annular interior space 702 with the interior space 308. In some cases, selection of the angular locations of the shroud dividers 704', 704" and/or the shroud apertures 706', 706" may set an angular portion of the annular interior space 702 to more effectively attenuate noise of a selected frequency and/or wavelength.

Figure 9:
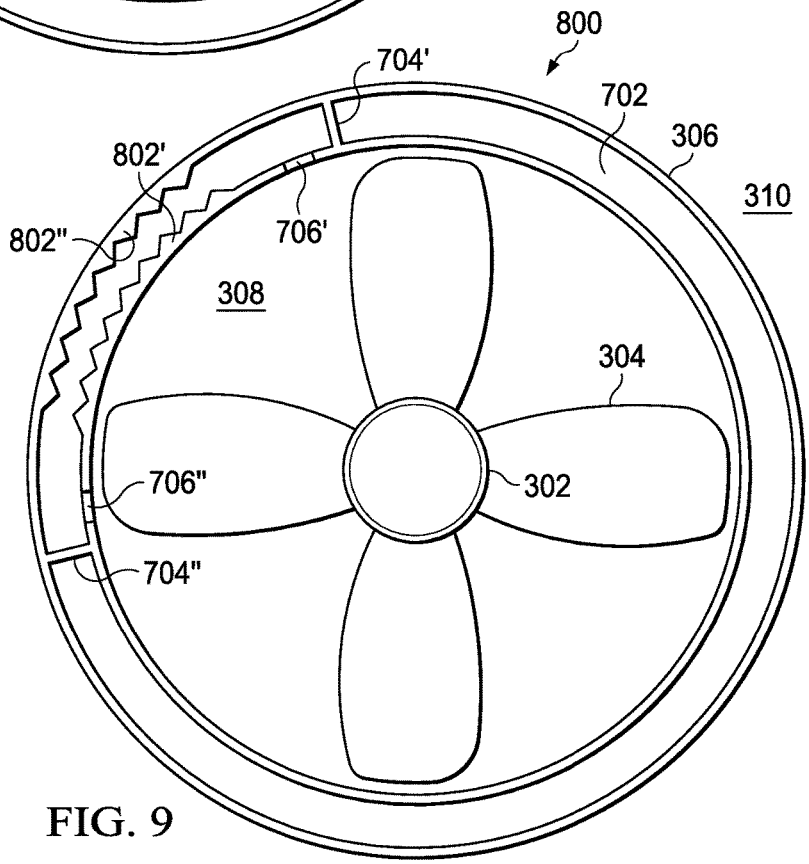
FIG. 9 is a schematic view of a fan assembly according to another embodiment of the disclosure.

Referring now to FIG. 9, an HVAC fan assembly 800 substantially similar to HVAC fan assembly 700 is shown. In this embodiment, one or more sound and/or pressure wave dissipation elements, in this case two sound and/or pressure wave dissipation elements 802', 802", may be disposed within the annular interior space 702. In some cases, the dissipation elements 802', 802" may comprise a foam material, an integral corrugation and/or projection of an interior wall of the shroud 306 and/or any other suitable sound muffling device.

Figure 10:
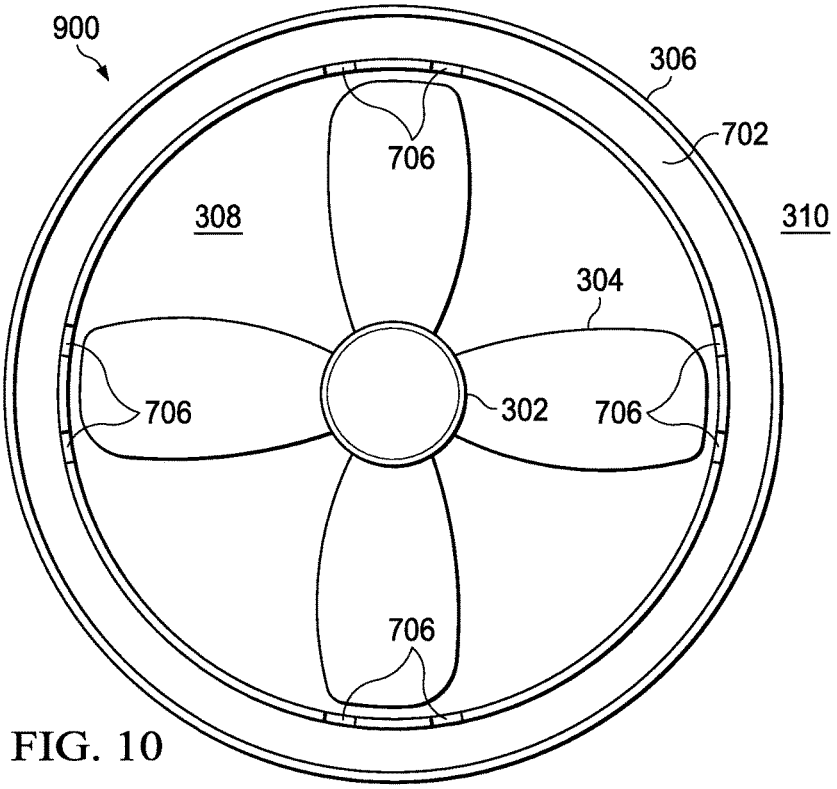
FIG. 10 is a schematic view of a fan assembly according to another embodiment of the disclosure.

Referring now to FIG. 10, an HVAC fan assembly 900 substantially similar to HVAC fan assembly 700 is shown. In this embodiment, however, there are no shroud dividers. In some cases, the HVAC fan assembly 900 may attenuate noise by providing a continuous annular interior space 702 that may be in fluid communication with the interior space 308 through a plurality of angularly distributed apertures 706.

Figure 11:
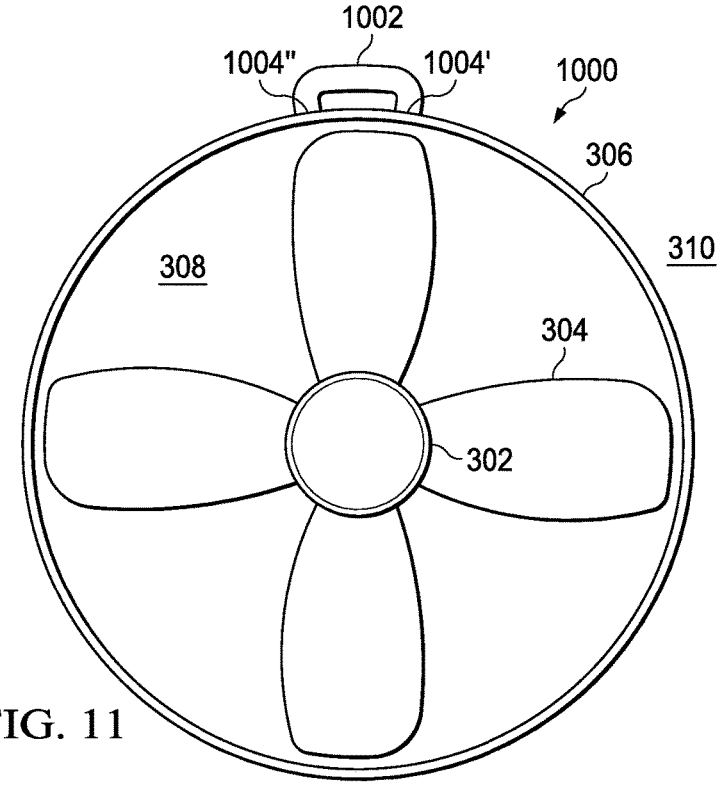
FIG. 11 is a schematic view of a fan assembly according to another embodiment of the disclosure.

Referring now to FIG. 11, an HVAC fan assembly 1000 substantially similar to outdoor fan 118 is shown. In this embodiment, a tube 1002 is provided that is connected in fluid communication with the interior space 308 at two relatively closely spaced angular locations 1004', 1004". In some cases, the angular distance between the angular locations 1004', 1004" may be less than half the angular distance between adjacent blade tips.

Figure 12:
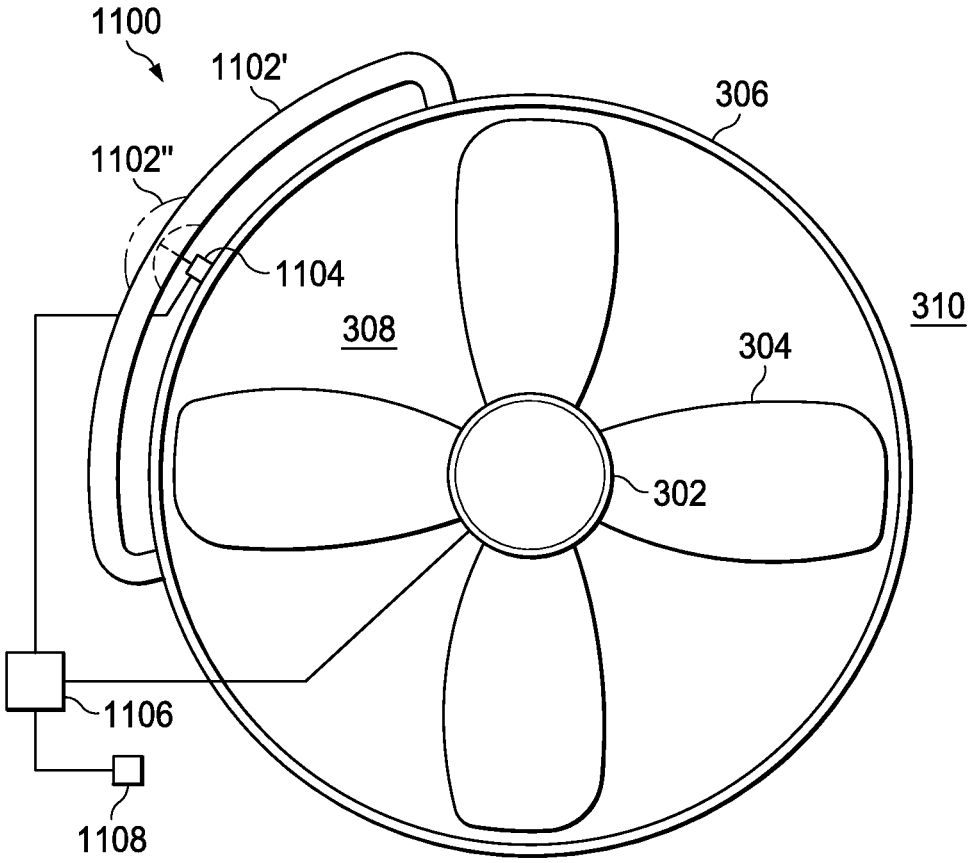
FIG. 12 is a schematic view of a fan assembly according to another embodiment of the disclosure.

Referring now to FIG. 12, an HVAC fan assembly 1100 substantially similar to outdoor fan 118 is shown. In this embodiment, the HVAC fan assembly 1100 comprises a tube 1102 that is flexible and variable in length so that it may be flexed between a relatively shorter configuration shown as tube 1102' and a relatively longer configuration shown as tube 1102". In some embodiments, a stepper motor and/or other actuator 1104 may be controlled by a tube controller 1106 to adjust the effective length of the tube 1102. In some embodiments, the tube controller 1106 may control the actuator 1104 in response to a change in speed of rotation of the motor 302 and/or the blade assembly 304. In alternative embodiments, the tube controller 1106 may control the actuator 1104 in response to a change in a BPF, tone, amplitude, wavelength, and/or any other characteristic of noise generated by the fan assembly 1100. In some cases, the characteristic of noise generated by the fan assembly 1100 may be sensed by a microphone 1108 and transmitted to the tube controller 1106. In some embodiments, the tube controller 1106 may be a portion of a system controller substantially similar to system controller 106. In alternative embodiments, the tube controller 1106 may comprise a computer and/or other hardware and/or software located remote from the installation location of an HVAC system.

Figure 13:
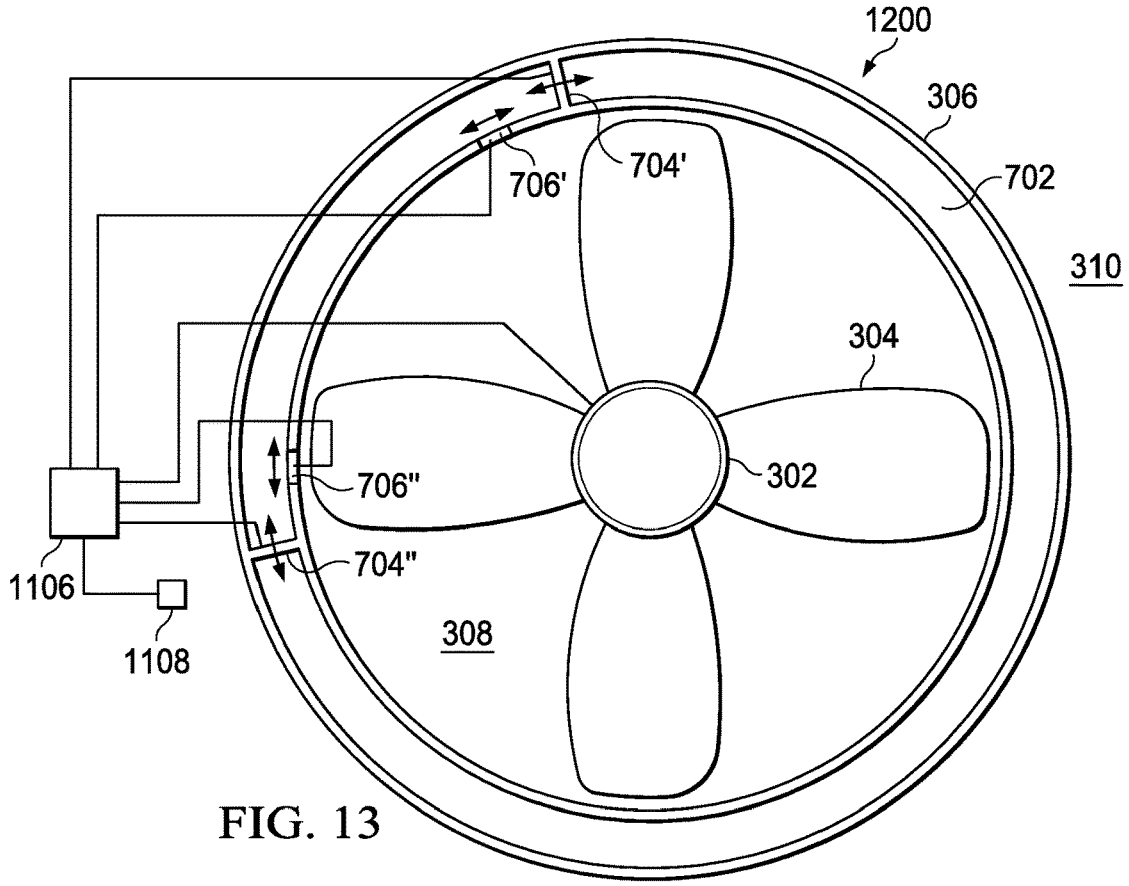
FIG. 13 is a schematic view of a fan assembly according to another embodiment of the disclosure.

Referring now to FIG. 13, an HVAC fan assembly 1200 substantially similar to HVAC fan assembly 1100 is shown. In this embodiment, the HVAC fan assembly 1200 comprises the annular interior space 702 and related shroud dividers 704', 704" and shroud apertures 706', 706". However, in this embodiment, the controller 1106 may be alternatively and/or additionally configured to move and/or control an angular location of one or more of the shroud dividers 704', 704" and shroud apertures 706', 706", in some cases, in response to a change in a BPF, tone, amplitude, wavelength, and/or any other characteristic of noise generated by the HVAC fan assembly 1200. In some cases, the characteristic of noise generated by the HVAC fan assembly 1200 may be sensed by the microphone 1108 and transmitted to the controller 1106.

In some cases, the controller 1106 may be utilized to tune the HVAC fan assembly 1200 in response to field conditions sensed by the microphone 1108, communicated to the controller 1106 by the motor 302 or a motor controller, and/or any other feedback provided to the controller 1106 that may be useful in selecting a number and/or location of shroud dividers 704 and/or shroud apertures 706. For example, a processor of a controller may execute instructions configured to evaluate field noise conditions in a residential installation environment and automatically respond to the field noise conditions by selecting and applying one or more shroud dividers 704 and/or shroud apertures 706 and their respective angular locations. In some embodiments, the controller 1106 may tune the HVAC fan assembly 1200 in response to acoustic data provided by a user and/or in response to acoustic data provided by any remote source of information connected to the HVAC fan assembly 1200. For example, other data provider 129 may provide a threshold acoustic value, such as a legal decibel limit value, in response to which the controller 1106 may tune the HVAC fan assembly 1200. In some cases, the controller 1106 may attempt to at least one of increase a power of a fan while not exceeding the legal decibel limit while in other cases the controller 1106 may tune the HVAC fan assembly 1200 to maintain a power of a fan while reducing noise attributable to the fan.

Figure 14:
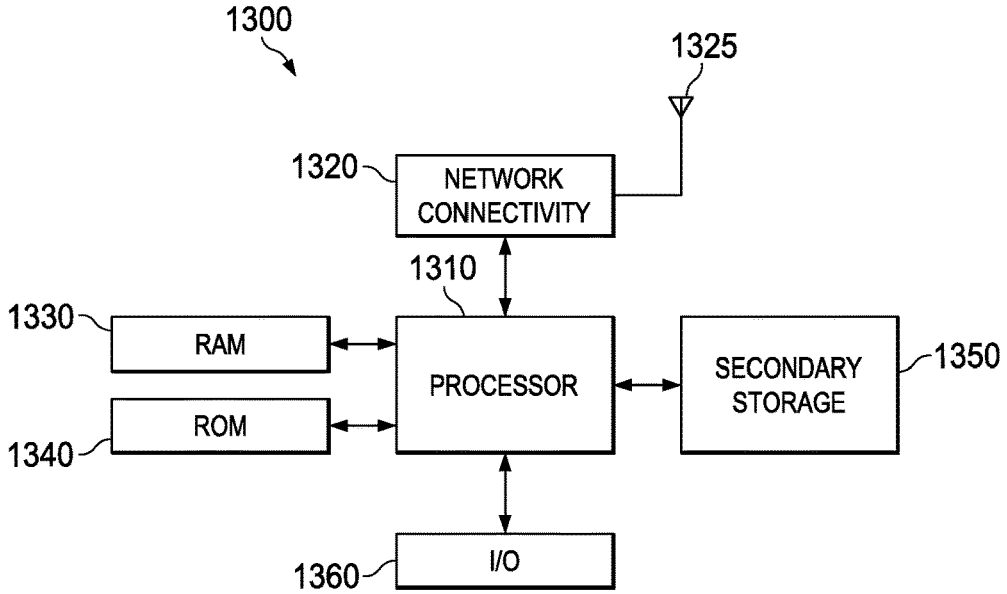
FIG. 14 is a simplified representation of a general-purpose processor (e.g. electronic controller or computer) system suitable for implementing the embodiments of the disclosure.

FIG. 14 illustrates a typical, general-purpose processor (e.g., electronic controller or computer) system 1300 that includes a processing component 1310 suitable for implementing one or more embodiments disclosed herein. In addition to the processor 1310 (which may be referred to as a central processor unit or CPU), the system 1300 might include network connectivity devices 1320, random access memory (RAM) 1330, read only memory (ROM) 1340, secondary storage 1350, and input/output (I/O) devices 1360. In some cases, some of these components may not be present or may be combined in various combinations with one another or with other components not shown. These components might be located in a single physical entity or in more than one physical entity. Any actions described herein as being taken by the processor 1310 might be taken by the processor 1310 alone or by the processor 1310 in conjunction with one or more components shown or not shown in the drawing.

The processor 1310 executes instructions, codes, computer programs, or scripts that it might access from the network connectivity devices 1320, RAM 1330, ROM 1340, or secondary storage 1350 (which might include various disk-based systems such as hard disk, floppy disk, optical disk, or other drive). While only one processor 1310 is shown, multiple processors may be present. Thus, while instructions may be discussed as being executed by a processor, the instructions may be executed simultaneously, serially, or otherwise by one or multiple processors. The processor 1310 may be implemented as one or more CPU chips.

The network connectivity devices 1320 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 1320 may enable the processor 1310 to communicate with the Internet or one or more telecommunications networks or other networks from which the processor 1310 might receive information or to which the processor 1310 might output information.

The network connectivity devices 1320 might also include one or more transceiver components 1325 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 1325 might include separate receiving and transmitting units or a single transceiver. Information transmitted or received by the transceiver 1325 may include data that has been processed by the processor 1310 or instructions that are to be executed by processor 1310. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 1330 might be used to store volatile data and perhaps to store instructions that are executed by the processor 1310. The ROM 1340 is a non-volatile memory device that typically has a smaller memory capacity than the memory capacity of the secondary storage 1350. ROM 1340 might be used to store instructions and perhaps data that are read during execution of the instructions. Access to both RAM 1330 and ROM 1340 is typically faster than to secondary storage 1350. The secondary storage 1350 is typically comprised of one or more disk drives or tape drives and might be used for non-volatile storage of data or as an over-flow data storage device if RAM 1330 is not large enough to hold all working data. Secondary storage 1350 may be used to store programs or instructions that are loaded into RAM 1330 when such programs are selected for execution or information is needed.

The I/O devices 1360 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, the transceiver 1325 might be considered to be a component of the I/O devices 1360 instead of or in addition to being a component of the network connectivity devices 1320. Some or all of the I/O devices 1360 may be substantially similar to various components disclosed herein.

Figure 15:
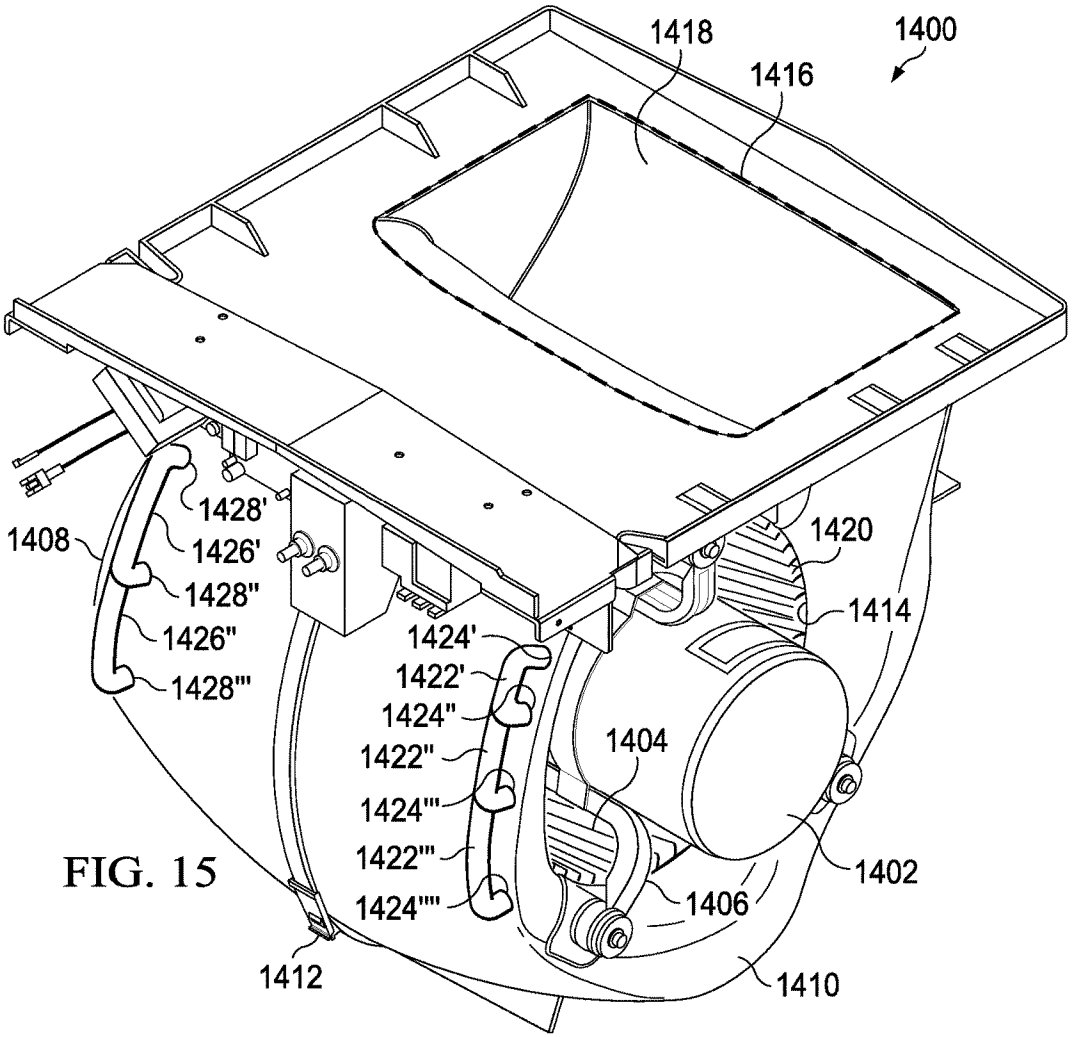
FIG. 15 is a schematic view of a fan assembly according to another embodiment of the disclosure.

Referring now to FIG. 15, an oblique view of an HVAC fan assembly 1400 according to an alternative embodiment of the disclosure is shown. In some embodiments, the indoor fan 110 may comprise an HVAC fan assembly 1400 and/or an HVAC fan assembly substantially similar to HVAC fan assembly 1400. The HVAC fan assembly 1400 comprises a motor 1402 having a shaft upon which an impeller 1404 is mounted. The motor 1402 is attached to a motor mount 1406 that holds the motor 1402 in place relative to a left shell 1408 of the HVAC fan assembly 1400 and a right shell 1410 of the HVAC fan assembly 1400. In this embodiment, left shell 1408 and the right shell 1410 are selectively joined together via integral snap features as well as retaining clips 1412. The snap features and the clips 1412 may be operated to optionally disconnect the left shell 1408 from the right shell 1410. The HVAC fan assembly 1400 further comprises an air input opening 1414, an air output opening 1416, and an interior space 1418. In this embodiment, the impeller 1404 comprises 54 blades 1420 disposed generally evenly and angularly about the central axis of the shaft of the motor 1402.

In a first embodiment, the HVAC fan assembly 1400 may comprise a plurality of tubes 1422', 1422", 1422'", and 1422"". In this embodiment, each of the tubes 1422', 1422", 1422'", and 1422"" are generally joined in common fluid communication to the interior space 1418 via at least one hole in the right shell 1410 at a first angular location 1424' associated with a first one of the blades. The tube 1422' is additionally in fluid communication with the interior space 1418 via a hole at a second angular location 1424" that is angularly offset from the first angular location 1424' that is, as measured by counting angularly consecutively disposed blades from the first blade, associated with a fourth blade. The tube 1422" is additionally in fluid communication with the interior space 1418 via a hole at a third angular location 1424'" that is angularly offset from the first angular location 1424' that is, as measured by counting angularly consecutively disposed blades from the first blade, associated with a ninth blade. The tube 1422'" is additionally in fluid communication with the interior space 1418 via a hole at a fourth angular location 1424"" that is, as measured by counting angularly consecutively disposed blades from the first blade, associated with a ninth blade.

In a second embodiment, the HVAC fan assembly 1400 may comprise a plurality of tubes 1426', 1426", and 1426'". In this embodiment, each of the tubes 1426', 1426", and 1426'" are generally joined in common fluid communication to the interior space 1418 via at least one hole in the left shell 1408 at a first angular location 1428' associated with a first one of the blades. The tube 1426' is additionally in fluid communication with the interior space 1418 via a hole at a second angular location 1428" that is angularly offset from the first angular location 1428' that is, as measured by counting angularly consecutively disposed blades from the first blade, associated with a twentieth blade. The tube 1426" is additionally in fluid communication with the interior space 1418 via a hole at a third angular location 1428'" that is angularly offset from the first angular location 1428' that is, as measured by counting angularly consecutively disposed blades from the first blade, associated with a thirty-third blade.

In alternative embodiments, the HVAC fan assembly 1400 may be provided with tubes and associated holes that give the tubes access to the interior space 1418 in any other combination and with any of the other tube features disclosed herein. In some cases, tubes may be connected in fluid communication with the interior space 1418 at angular locations associated with random angular connection locations, non-repeating sequences of angular locations, and/or angular locations associated with primarily prime numbers that have no common factor or very few common factors.

It will be appreciated that while the above embodiments disclose the application of the systems and methods of the disclosure to primarily an axial fan of an HVAC condensing unit, in alternative embodiments, systems and methods may similarly be applied to radial fans, mixed flow fans, blower enclosures, and/or any other fan system in which a blade assembly is rotated and/or a blade pass frequency is generated and regardless the type of HVAC unit (whether indoor, outdoor, commercial, residential, etc.). In some cases, one or more of the above-described systems may be utilized to selectively amplify an HVAC system sound. In alternative embodiments, one or more of the above-described systems may be applied to systems other than HVAC systems. Further, in some embodiments, one or more of the above-described systems and methods may be used to selectively amplify, attenuate, generate, alter, shift, augment, harmonize, and/or otherwise change a sound and/or noise of a selected frequency.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and/or air conditioning (HVAC) system, comprising:

a fan, comprising:

a blade assembly;

a cover;

a fan component defining a radially interior space disposed radially inside and bounded by the fan component and a radially exterior space located radially beyond the fan component and within a footprint of the cover; and a tube disposed in the radially exterior space, the tube being connected in exclusive fluid communication with the radially interior space at a first angular location and a second angular location different from the first angular location with respect to an axis of rotation of a shaft of the blade assembly, wherein the first angular location and the second angular location comprise substantially similar longitudinal locations.

2. The HVAC system of claim 1, wherein the tube is variable in length.

3. The HVAC system of claim 1, wherein the tube is further in communication with the radially interior space at a third angular location.

4. The HVAC system of claim 1, wherein the fluid communication between the tube and the radially interior space is provided through an aperture in the fan component.

5. The HVAC system of claim 1, wherein the tube comprises an undulating shape.

6. The HVAC system of claim 1, further comprising an additional tube in fluid communication with the radially interior space at two angular locations.

7. The HVAC system of claim 6, wherein at least one of the two angular locations at which the additional tube is connected in fluid communication with the radially interior space is one of the first angular location and the second angular location.

8. The HVAC system of claim 7, wherein the tubes comprise different effective lengths.

9. The HVAC system of claim 1, wherein the tube comprises an enlarged section.

10. A fan component, comprising:

a cover defining an internal space;

a shroud defining a radially interior space disposed radially inside the shroud and a radially exterior space located radially beyond the shroud and within the internal space defined by the cover;

wherein the radially interior space is joined in exclusive fluid communication via a tube disposed in the radially exterior space between a first angularly located aperture and a second angularly located aperture that is angularly offset from the first angularly located aperture with respect to an axis of rotation of a shaft of a blade assembly, wherein the first angularly located aperture and the second angularly located aperture comprise substantially similar longitudinal locations.

11. The fan component of claim 10, further comprising a pressure wave attenuation material disposed within the radially exterior space.

12. A method of altering a heating, ventilation, and/or air conditioning (HVAC) system noise characteristic, comprising:

providing a fan comprising a fan component defining a radially interior space disposed radially inside and bounded by the fan component and a radially exterior space located radially beyond the fan component and within a footprint of a cover of the fan;

providing a blade assembly at least partially within the radially interior space;

rotating the blade assembly about a longitudinal axis; and joining at least two angularly offset locations of the interior space in exclusive fluid communication with each other via a tube disposed in the radially exterior space, wherein the at least two angularly offset locations comprise a substantially similar longitudinal location with respect to the longitudinal axis.

13. The method of claim 12, further comprising:

adjusting a length of the tube in response to a change in blade pass frequency.

14. The method of claim 12, wherein the joining the tube with the interior space comprises providing an aperture through a wall of the fan component.

15. A method of altering a heating, ventilation, and/or air conditioning (HVAC) system noise characteristic, comprising:

providing a fan comprising a fan component defining a radially interior space disposed radially inside and bounded by the fan component and a radially exterior space located radially beyond the fan component and within a footprint of a cover of the fan;

providing a blade assembly at least partially within the radially interior space;

rotating the blade assembly about a longitudinal axis;

joining at least two angularly offset locations of the interior space in exclusive fluid communication with each other via a tube disposed in the radially exterior space, wherein the at least two angularly offset locations comprise a substantially similar longitudinal location with respect to the longitudinal axis; and disposing a noise attenuating material patch between the blade assembly and the fan component at an angular location selected to at least one of disrupt, reduce, and prevent a pressure wave.

* * * * *